US012275051B2

(12) United States Patent
Wang et al.

(10) Patent No.: US 12,275,051 B2
(45) Date of Patent: Apr. 15, 2025

(54) STAMPING DEVICE AND MULTI-LANE SHELL STAMPING SYSTEM

(71) Applicant: SUZHOU SLAC PRECISION EQUIPMENT CO., LTD, Jiangsu (CN)

(72) Inventors: Bingsheng Wang, Suzhou (CN); Kang Xiong, Suzhou (CN); Yao Yao, Suzhou (CN); Shichao Shao, Suzhou (CN); Donghai Yang, Suzhou (CN); Xuejing Zhang, Suzhou (CN)

(73) Assignee: SUZHOU SLAC PRECISION EQUIPMENT CO., LTD, Suzhou (CN)

( * ) Notice: Subject to any disclaimer, the term of this patent is extended or adjusted under 35 U.S.C. 154(b) by 719 days.

(21) Appl. No.: 17/292,626

(22) PCT Filed: Sep. 18, 2019

(86) PCT No.: PCT/CN2019/106439
§ 371 (c)(1),
(2) Date: May 10, 2021

(87) PCT Pub. No.: WO2020/193794
PCT Pub. Date: May 14, 2020

(65) Prior Publication Data

US 2021/0291248 A1 Sep. 23, 2021

(30) Foreign Application Priority Data

Nov. 8, 2018 (CN) ..... 201811324381.3

(51) Int. Cl.
*B21D 22/22* (2006.01)
*B21D 22/02* (2006.01)
(Continued)

(52) U.S. Cl.
CPC ..... *B21D 22/02* (2013.01); *B21D 37/10* (2013.01); *B21D 43/003* (2013.01)

(58) Field of Classification Search
CPC ..... B21D 37/10; B21D 43/02; B21D 43/003; B21D 43/12; B21D 51/44; B21D 51/446; B21D 22/22
See application file for complete search history.

(56) References Cited

U.S. PATENT DOCUMENTS 3,380,282 A 4/1968 Scarletta et al.
2016/0059297 A1* 3/2016 Dunwoody ..... B21D 51/44 72/349

FOREIGN PATENT DOCUMENTS

CN 1642671 A 7/2005
CN 101623728 A 1/2010
(Continued)

OTHER PUBLICATIONS

Dec. 30, 2019 Search Report issued in International Patent Application No. PCT/CN2019/106439.

*Primary Examiner* — Debra M Sullivan
(74) *Attorney, Agent, or Firm* — Oliff PLC

(57) ABSTRACT

This application discloses a stamping device and a multi-lane shell stamping system, and the stamping device is used for simultaneous stamping of multiple shells, comprising a plurality of stamping die sets arranged in an array. Each stamping die set comprises an upper die and a lower die. The upper die is integrally formed, and the outer diameter of the upper die is larger than that of the lower die, and the bottom edge of the upper die forms a locating part for the curling of the shell to be processed. The present invention eliminates the movable locating cup, which can avoid the difficulty of mounting and dismounting the die due to the compact six-lane structure. At the same time, it adopts the method of directly increasing the diameter of the upper die, which not
(Continued)

only avoids the mounting and dismounting of the locating cup, but also realizes the locating effect of the shell.

8 Claims, 7 Drawing Sheets

(51) Int. Cl.
*B21D 37/10* (2006.01)
*B21D 43/00* (2006.01)

(56) References Cited

FOREIGN PATENT DOCUMENTS

| | | | | | |
|---|---|---|---|---|---|
| CN | 104972304 | A | | 10/2015 | |
| CN | 109158503 | A | | 1/2019 | |
| CN | 109158504 | A | | 1/2019 | |
| CN | 109396287 | A | | 3/2019 | |
| CN | 209077643 | U | | 7/2019 | |
| JP | H10-193011 | A | | 7/1998 | |
| WO | WO-0187515 | A1 | * | 11/2001 | ..... B21D 51/44 |

* cited by examiner

STAMPING DEVICE AND MULTI-LANE SHELL STAMPING SYSTEM

TECHNICAL FIELD

The application relates to a shell manufacturing equipment, in particular to a stamping device and a multi-lane shell stamping system.

BACKGROUND OF INVENTION

At present, the fastest production capacity of the basic shell system on the market has reached 9,000 shells/min (four lanes), while the conversion speed is only 3,000 shells/min, which is difficult to meet market demand.

In order to further improve efficiency, the compactness, stamping precision and stability of the equipment are the problems difficult to overcome.

In addition, as shown in FIG. 1*a* and FIG. 1*b*, in the traditional means, when the shell 501 is pressed by the upper die 502 and the lower die 503, it needs the help of the locating cup 504 of the movable structure to correct the position of the shell through the locating cup in advance, so as to achieve the locating effect. However, due to the arrangement of the dies and the compact space, the use of the locating cup increases the difficulty of mounting and dismounting of the dies.

DISCLOSURE OF THE INVENTION

The object of the present invention is to provide a stamping device and a multi-lane shell stamping system, so as to overcome the shortcomings of the prior art.

To fulfill the above object, the present invention provides the following technical solution:

The embodiment of the present application discloses a stamping device for simultaneous stamping of multiple shells, comprising a plurality of stamping die sets arranged in an array, Each stamping die set comprises an upper die and a lower die, The upper die is integrally formed, and the outer diameter of the upper die is larger than that of the lower die, and the bottom edge of the upper die forms a locating part for the curling of the shell to be processed.

Preferably, in the stamping device, both the upper die and the lower die have a cylindrical body part, and the upper die and the lower die are arranged coaxially.

Preferably, in the stamping device, the lower edge of the upper die has an arc-shaped chamfer.

Preferably, in the stamping device, the system comprises six stamping lanes for the shells.

Correspondingly, the application also discloses a multi-lane shell stamping system, which comprises:

A down-stacker;

A conveying component, which is arranged under the down-stacker to convey the shells from the down-stacker component to the processing station of the stamping component;

Any of the stamping devices.

Preferably, in the multi-lane shell stamping system, the conveying component comprises a plurality of synchronous belts arranged in parallel, and both ends of the synchronous belt are respectively driven by belt pulleys, and each synchronous belt is respectively provided with multiple rows of shell locating holes.

Preferably, in the multi-lane shell stamping system, the adjacent locating holes on each synchronous belt are staggered along the conveying direction.

Preferably, in the multi-lane shell stamping system, the down-stacker component comprises a support plate and a plurality of shell distributors fixed on the upper surface of the support plate.

Preferably, in the multi-lane shell stamping system, each shell distributor comprises a base, a shell container and two shell distributing wheels, The shell container and the shell distributing wheels are arranged on the base, Two shell distributing wheels are symmetrically arranged on both sides of the shell container.

Preferably, in the multi-lane shell stamping system, all shell distributing wheels on the support plate are driven and connected by the same belt.

Compared with the prior art, the advantages of the present invention are: The invention eliminates the movable locating cup, which can avoid the difficulty of mounting and dismounting the die due to the compact six-lane structure. At the same time, it adopts the method of directly increasing the diameter of the upper die, which not only avoids the mounting and dismounting of the locating cup, but also realizes the locating effect of the shell.

BRIEF DESCRIPTION OF THE DRAWINGS

In order to more clearly illustrate the technical solutions in the embodiments of the present application or the prior art more clearly, the following is the brief illustration of the drawings that need to be used in the description of the embodiments or the prior art. Obviously, the drawings in the following description are only some of the embodiments in this application. For those skilled in the art, other drawings can be obtained from these drawings without any creative work.

SPECIFIC EMBODIMENT

Figure 1A:
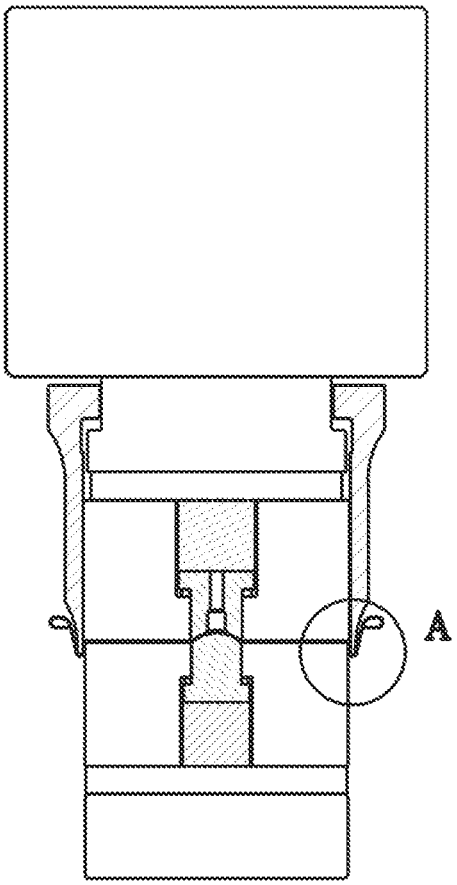
Fig. 1a RELATED ART
FIG. 1*a* shows a schematic view of the structure of a stamping die in the prior art.

The following is the clear and complete description of the technical solutions with the accompanying drawings. Obviously, the described embodiments are part of the embodiments of the present invention, rather than all of them. All other embodiments obtained by those of ordinary skill in the art without creative work based on the embodiments of the present invention shall fall within the protection scope of the present invention.

In the description of the present invention, it should be noted that the orientation or position relationship indicated by the terms "center", "up", "down", "left", "right", "vertical", "horizontal", "inside", "outside" is based on the orientation or position relationship shown in the drawings, and it is only for the convenience of describing and simplifying the description, rather than indicating or implying that the device or component referred to must have a specific orientation, be constructed and operated in a specific orientation, so it cannot be understood as a limitation of the invention. In addition, the terms "first", "second" and "third" are only used for description and cannot be understood to indicate or imply relative importance.

In the description of the present invention, it should be noted that unless otherwise specified and limited, the terms "installation", "connection" and "junction" should be understood in a broad sense. For example, it can be a fixed connection, a detachable connection or an integral connection; it can be a mechanical connection or an electrical connection; it can be a direct connection or an indirect connection through an intermediate medium, and it can be an internal connection of two components. For those of ordinary skill in the art, the specific meaning of the above terms in the present invention can be understood in specific cases.

Figure 1B:
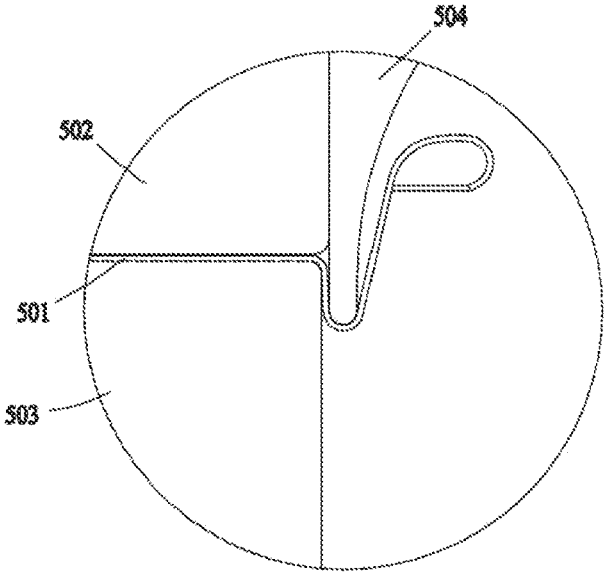
Fig. 1b RELATED ART
FIG. 1*b* shows an enlarged schematic view of A in FIG. 1*a*.
Figure 1C:
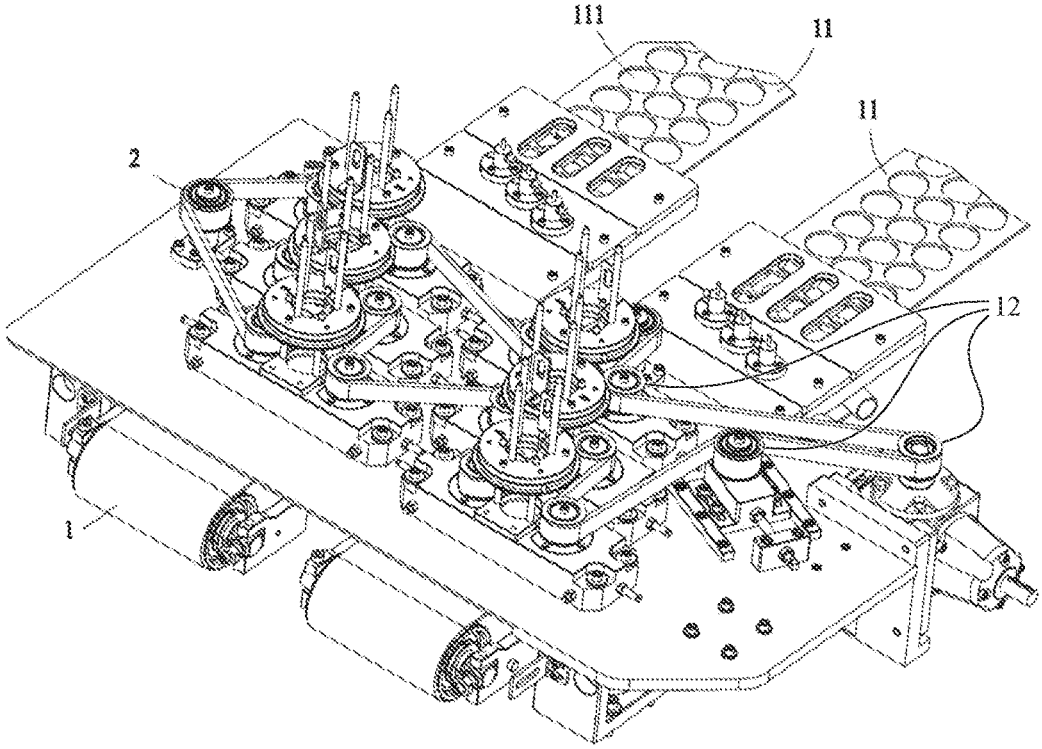
FIG. 1*c* shows a stereoscopic view of a combined stamping system in a specific embodiment of the present invention.

As shown in FIG. 1, the embodiment of the application provides a multi-lane shell stamping system, which comprises a conveying component 1, a down-stacker 2 and a stamping component 3.

In this embodiment, a 6-lane stamping structure is used as an example. It should be noted that the stamping system in this case is also suitable for systems with more than 6 lanes. The description will not be repeated in this case as the structures and principles are similar.

The conveying component 1 is arranged under the down-stacker 2 to convey the shells from the down-stacker component to the processing station of the stamping component 3.

The conveying component 1 comprises two synchronous belts 11 arranged in parallel, and both ends of the synchronous belt 11 are respectively driven by the belt pulleys 12.

And each synchronous belt 11 is respectively provided with 3 rows of shell locating holes 111. Each locating hole 111 is used to correspond to a shell. In the process of moving in the horizontal direction, the synchronous belt can drive the shells to move to the processing station synchronously.

Furthermore, in order to make the locating holes 111 more compact and reduce the width of the synchronous belt, the locating holes 111 of adjacent rows are staggered along the conveying direction on each synchronous belt.

It is easy to think that the conveying component 1 can also be provided with only one wider synchronous belt, which is directly provided with 6 rows of locating holes. But this embodiment will bring problems such as cost increase, so it is not the preferred solution in this case.

Figure 2:
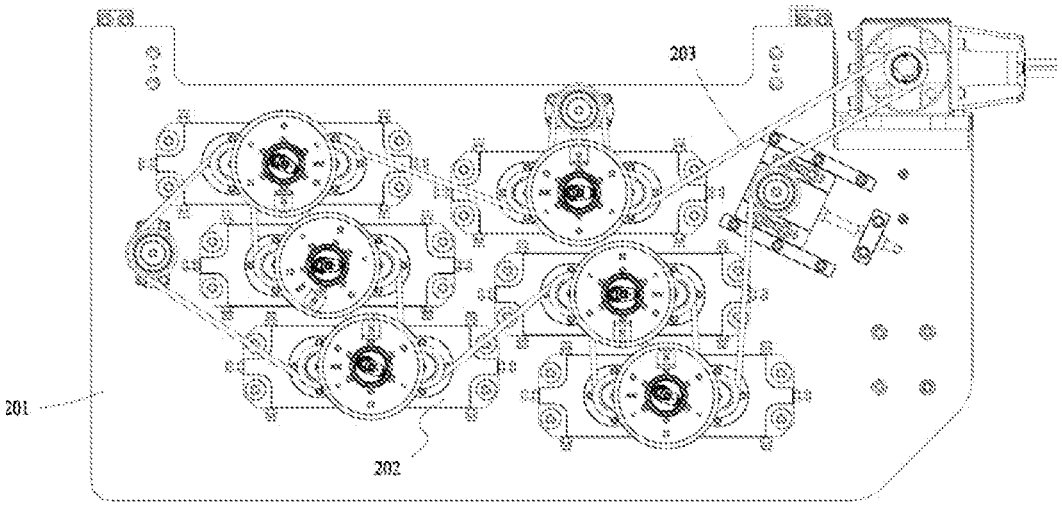
FIG. 2 shows a top view of the down-stacker component in a specific embodiment of the present invention.
Figure 3:
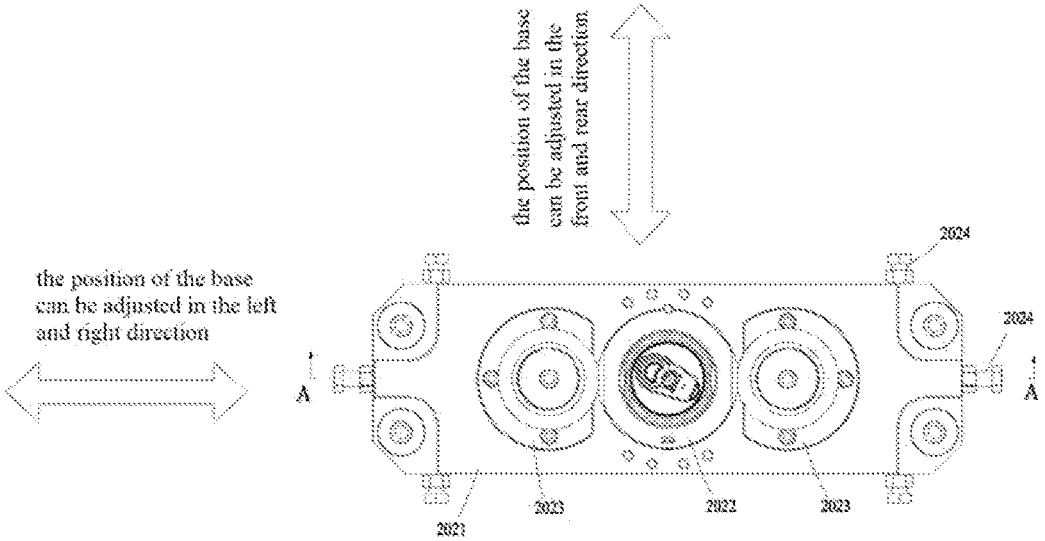
FIG. 3 shows a schematic view of a shell distributor in a specific embodiment of the present invention.
Figure 4:
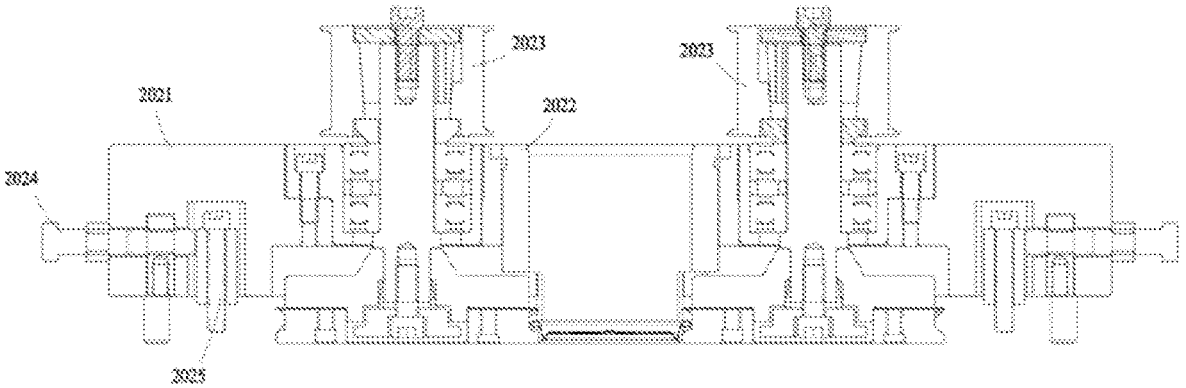
FIG. 4 shows a section view of A-A in FIG. 3.

As shown in FIG. 2 to FIG. 4, the down-stacker 2 comprises a support plate 201 and six shell distributors 202 fixed on the upper surface of the support plate 201.

The support plate 201 is horizontally supported above the two synchronous belts 11, and each shell distributor 202 corresponds to a shell locating hole 111 on the synchronous belt.

Regarding six-lane shell conveyor synchronous belt, due to the compact arrangement on the synchronous belt, the distance between the holes (shell locating holes) becomes smaller, the strength becomes weaker, and the deformation of the holes will increase after the synchronous belt is tightened.

In order to ensure that the shell distributor can still be aligned with the shell locating hole in case of hole deformation of the synchronous belt, the displacement of each shell distributor 202 in this embodiment is independently adjustable in the horizontal plane as shown in the FIG. 2.

As shown in FIG. 3, each shell distributor 202 comprises a base 2021, a shell container 2022 and two shell distributing wheels 2023. The shell container 2022 and the shell distributing wheels 2023 are arranged on the base 2021, and the two shell distributing wheels 2023 are symmetrically arranged on both sides of the shell container 2022.

Furthermore, all of the shell distributing wheels 2023 (12 shell distributing wheels) located on the support plate 201 are driven and connected by the same belt.

Assuming an XY coordinate system in the horizontal plane, the displacement of each shell distributor 202 in X direction and Y direction can be adjusted independently.

Furthermore, the X direction is perpendicular to the direction in which the shell locating holes 111 are aligned in a row.

As shown in FIG. 4, an adjusting device 2024 is arranged on the side of the base 2021, and the base 2021 can move in the X or Y direction through the adjusting device 2024.

The adjusting device 2024 comprises a plurality of adjusting screws distributed around the base 2021, and a locating block 2025 is installed on the support plate 201 to cooperate with the adjusting screws. When it is necessary to adjust the displacement of the base in a specific direction, rotate the adjusting screws on both sides of the base in that direction to make the adjusting screws touch the locating block 2025 to realize the movement of the base 2021 in the X or Y direction.

In the technical solution, the front and back, left and right directions of the base of each shell distributor can be adjusted through the independently adjustable structure of the shell distributor. In this way, it is convenient for each shell distributor to align with the positioning hole of the synchronous belt.

Figure 5:
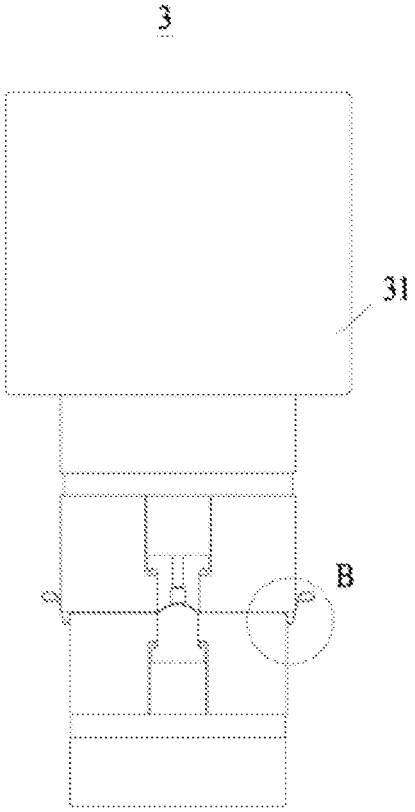
FIG. 5 shows a schematic view of a stamping die set in a specific embodiment of the present invention.
Figure 6:
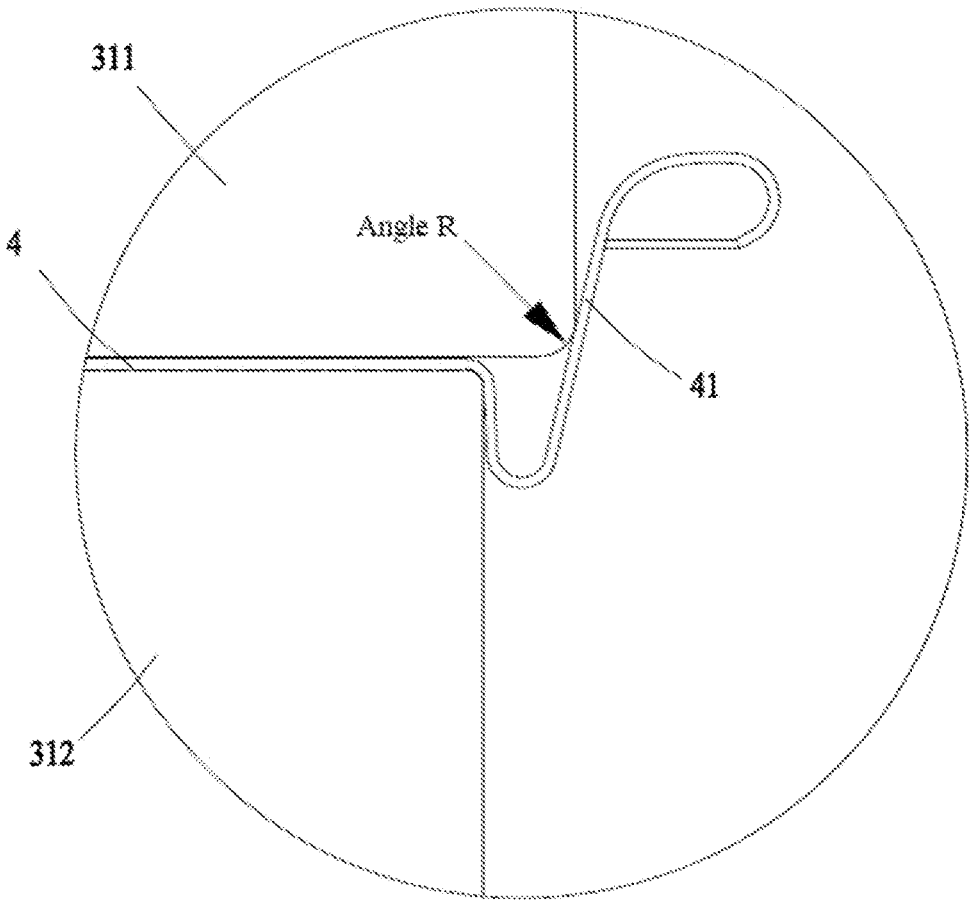
FIG. 6 shows an enlarged schematic view of B in FIG. 5.

As shown in FIG. 5 and FIG. 6, the stamping component 3 comprises a plurality of stamping die sets 31 arranged in an array, and each stamping die set 31 stamping die sets an upper die 311 and a lower die 312 respectively.

Figure 8:
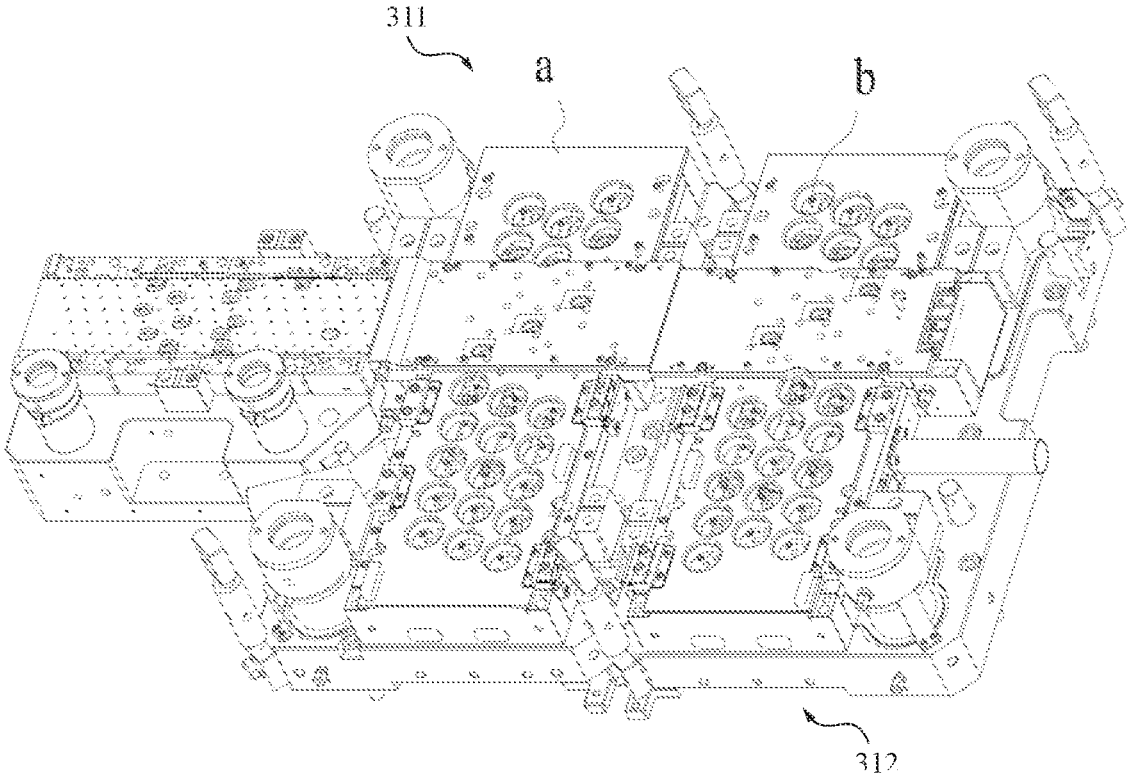
FIG. 8 shows a schematic view of a 6-lane die in a specific embodiment of the present invention.

As shown in FIG. 8, in a preferred embodiment, the stamping component 3 comprises two dies a, and each die a is integrated with 3 rows of lower dies 312, so that each die a forms 3 lane structures b, and each lane b is provided with a plurality of lower dies 312 in the corresponding array, and the lower dies 312 are linearly arranged, and each lower die 312 corresponds to a locating hole on the synchronous belt.

The upper die 311 and the lower die 312 are respectively arranged above and under the synchronous belt 11. The shell 4 on the synchronous belt 11 will be stamped when the upper die 311 and the lower die 312 are close together.

The forming process of the shell 4 is generally that the metal material is first punched by the punching machine to form a raw cover, then curled by the curling machine, injected by the glue injection machine, and finally dried by the dryer to get the shell 4 to be further processed by the stamping die set 31.

When the stamping die sets 31 stamps the shells 4 with curling 41, it's necessary to locate the curling. Since the stamping die sets 31 are arranged with six lanes in parallel in the embodiment, it's necessary to avoid the mounting and dismounting of stamping die sets 31 as far as possible after the parallel installation in order to maintain its compactness.

In order to solve this problem, in this embodiment, the upper die 311 is integrally formed, and the outer diameter of the upper die 311 is larger than that of the lower die, and the bottom edge of the upper die 311 forms the locating part of the curling 41.

As shown in FIG. 6, the upper die 311 and the lower die 312 each have a cylindrical main body, and the upper die 311 and the lower die 312 are coaxially arranged. After the upper die 311 and the lower die 312 approach and start extrusion, the edge of the upper die 311 protrudes around the top of the lower die 312, and the R angle of the lower edge of the upper die 311 butts against the top surface of the curling 41, forming a circular contact locating.

In a preferred embodiment, the lower edge of the upper die 311 has an arc-shaped chamfer.

In this embodiment, it eliminates the movable locating cup, which can avoid the difficulty of mounting and dismounting the die due to the compact six-lane structure. At the same time, it adopts the method of directly increasing the diameter of the upper die, which not only avoids the mounting and dismounting of the locating cup, but also realizes the locating effect of the shell.

Figure 7:
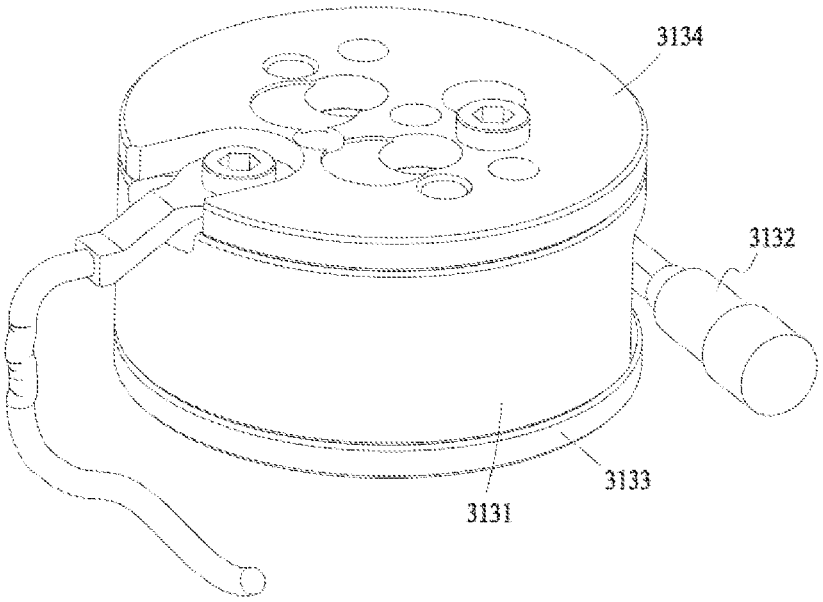
FIG. 7 shows a stereoscopic view of a heater component in a specific embodiment of the present invention.

As shown in FIG. 7, the preset intervals of the upper die 311 and the lower die 312 are easy to change during long-term use. In order to control and adjust the intervals, the height of upper surface of the lower die 312 in this embodiment is adjustable.

Furthermore, the lower die 312 is supported on an adjustable component 313, and the adjustable component 313 comprises a heater component 3131 subject to thermal expansion and cold contraction.

The heater component 3131 may be made of a metal material having a stable coefficient of linear expansion.

In this technical solution, the heater component 3131 is connected with a thermocouple 3132. The temperature is controlled by the thermocouple to make the heater component expand and contract up and down to control the overall height of the die, so as to achieve the purpose of accurate and quick control of product parameters.

In the preferred embodiment, the shape of the heater component 3131 matches that of the lower die 312, both of which are cylindrical. In the process of thermal expansion and cold contraction, the shape change mainly reflects in the height direction.

In order to avoid downward heat transfer of heater component 3131, a thermal insulation gasket 3133 is attached on the lower surface of heater component 3131.

In the preferred embodiment, the thermal insulation gasket 3133 is the thermal insulation ceramic gasket.

In other embodiments, as long as it can satisfy the requirement of thermal insulation and low thermal expansion coefficient.

In an embodiment, an upper gasket 3134 can be arranged between the heater component 3131 and the lower die 312.

Furthermore, the upper gasket 3134 is a metal gasket. It is preferably a steel gasket.

In this technical solution, the upper gasket 3134 can also be ceramic gasket, but the cost of ceramic material is high, and the ceramic gasket on the heater component 3131 is easy to be damaged in the process of mounting and dismounting of the die.

After the experimental tests, the ceramic gasket is replaced by steel material in this embodiment, which can also achieve the use effect and avoid the frequent damage of parts.

Compared with the 4-lane system, the 6-lane stamping system in this embodiment can increase the combined stamping speed to 4500 shells/min, and increase the production capacity by 50%.

In summary, the technical solution of the present invention is suitable for stamping systems with 6 lanes or more. In order to ensure its compactness, this solution improves its comprehensive performance through three aspects: on the one hand, the base is improved to make the displacement of each base independently adjustable; on the other hand, the locating cup structure on the upper die is eliminated; on the other hand, the lower die is provided with a height adjusting structure subject to thermal expansion and cold contraction.

Finally, it should be noted that the above embodiments are only used to illustrate the technical solution of the invention, but not to limit it; although the present invention has been described in detail with reference to the above embodiments, those of ordinary skill in the art should understand that: it's still possible to modify the technical solutions described in the above-mentioned embodiments, or replace some or all of the technical features equivalently; and these modifications or replacements do not make the essence of the corresponding technical solutions out of the scope of the technical solutions of the embodiments of the present invention.

The invention claimed is:

1. A multi-lane shell stamping system comprising:

a down-stacker component;

a conveying component, which is arranged under the down-stacker component to convey multiple shells from the down-stacker to a processing station of a stamping component; and a stamping device for simultaneous stamping of the multiple shells, the stamping device comprising:

a plurality of stamping die sets arranged in an array, wherein:

each stamping die set comprises an upper die and a lower die, the upper die and the lower die being coaxially arranged, the upper die is integrally formed, and an outer diameter of the upper die is larger than that of the lower die, and the bottom edge of the upper die forms a circular locating part for the curling of the shell to be processed by virtue of an edge of the upper die protruding around a top of the lower die, and an angle of the bottom edge of the upper die abuts against a top surface of the curling, and the down-stacker component comprises a support plate and a plurality of shell distributors fixed on the upper surface of the support plate.

2. The multi-lane shell stamping system according to claim 1, wherein both the upper die and the lower die have a cylindrical body part.

3. The multi-lane shell stamping system according to claim 1, wherein the bottom edge of the upper die has an arc-shaped chamfer.

4. The multi-lane shell stamping system according to claim 1, further comprising six stamping lanes arranged in parallel, the six stamping lanes provided for respective ones of the shells.

5. The multi-lane shell stamping system according to claim 1, wherein:

the conveying component comprises a plurality of synchronous belts arranged in parallel, and both ends of the synchronous belt are respectively driven by belt pulleys, and each synchronous belt is respectively provided with multiple rows of shell locating holes.

6. The multi-lane shell stamping system according to claim 5, wherein the adjacent locating holes on each synchronous belt are staggered along the conveying direction.

7. The multi-lane shell stamping system according to claim 1, wherein:

each shell distributor comprises a base, a shell container and two shell distributing wheels, the shell container and the shell distributing wheels are arranged on the base, two shell distributing wheels are symmetrically arranged on both sides of the shell container.

8. The multi-lane shell stamping system according to claim 7, wherein all shell distributing wheels on the support plate are driven and connected by a same synchronous belt.

* * * * *